US010141624B2

(12) United States Patent
Stratis et al.

(10) Patent No.: US 10,141,624 B2
(45) Date of Patent: Nov. 27, 2018

(54) METHOD FOR DYNAMIC HEAT SENSING IN HYPERSONIC APPLICATIONS

(71) Applicant: Raytheon Company, Waltham, MA (US)

(72) Inventors: Glafkos K. Stratis, Lake Worth, FL (US); Anton Vanderwyst, Tucson, AZ (US); Wayne L. Sunne, Tucson, AZ (US); David G. Derrick, Vail, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 234 days.

(21) Appl. No.: 15/176,700

(22) Filed: Jun. 8, 2016

(65) Prior Publication Data

US 2017/0358836 A1 Dec. 14, 2017

(51) Int. Cl.

| | |
|---|---|
| ***H01Q 1/02*** | (2006.01) |
| ***F42B 10/46*** | (2006.01) |
| ***H01Q 1/42*** | (2006.01) |
| ***H01Q 1/28*** | (2006.01) |
| ***F42B 15/34*** | (2006.01) |
| ***H01Q 5/22*** | (2015.01) |
| ***H01Q 1/00*** | (2006.01) |
| *F42B 15/00* | (2006.01) |

(52) U.S. Cl.

CPC ..... *H01Q 1/02* (2013.01); *F42B 10/46* (2013.01); *F42B 15/34* (2013.01); *H01Q 1/002* (2013.01); *H01Q 1/28* (2013.01); *H01Q 1/281* (2013.01); *H01Q 1/42* (2013.01); *H01Q 5/22* (2015.01)

(58) Field of Classification Search

CPC .. H01Q 1/02; H01Q 1/28; H01Q 1/42; H01Q 5/22; H01Q 1/281; H01Q 1/002; F42B 15/34; F42B 10/46; B64C 1/38; B64G 1/50; B64G 1/503; B64G 1/58; G01K 11/006; G01K 13/04; G01K 13/06; G01P 5/14

USPC ..... 244/171.8, 159.1, 171.7

See application file for complete search history.

(56) References Cited

U.S. PATENT DOCUMENTS 3,120,364 A 2/1964 Stalony-Dobrzanski
3,410,502 A * 11/1968 Leadon et al. ..... B64G 1/50
3,542,314 A * 11/1970 Bey ..... B64G 1/50
(Continued)

OTHER PUBLICATIONS

R. H. Dicke, "The Measurement of Thermal Radiation at Microwave Frequencies"; The Review of Scientific Instruments; vol. 17, No. 7; Jul. 1946. (Year: 1946).*
(Continued)

*Primary Examiner* — Bernarr E Gregory
(74) *Attorney, Agent, or Firm* — Renner, Otto, Boisselle & Sklar, LLP

(57) ABSTRACT

A heat sensing system and method for dynamic heat sensing may be implemented in a flight vehicle having a main antenna configured for sending and/or receipt of signals. The system includes an auxiliary antenna system that is arranged within a radome of the flight vehicle for detecting temperatures around the exterior surface of the radome. The auxiliary antenna is configured for receiving and measuring infrared or optical energy. Using the measured energy, the system is configured to determine whether the detected temperature exceeds a predetermined temperature and rotating the vehicle to equalize heat around the vehicle when the current temperature exceeds the predetermined temperature.

19 Claims, 11 Drawing Sheets

(56) References Cited

U.S. PATENT DOCUMENTS

| | | | | | |
|---|---|---|---|---|---|
| 3,599,207 | A | * | 8/1971 | Foiani | G01K 11/006 342/190 |
| 3,777,270 | A | * | 12/1973 | Hardy | G01K 11/006 342/351 |
| 4,580,748 | A | * | 4/1986 | Dalby | B64G 1/503 165/903 |
| 4,669,685 | A | * | 6/1987 | Dalby | B64G 1/503 165/6 |
| 4,673,298 | A | * | 6/1987 | Hunter | G01K 11/006 374/122 |
| 4,968,879 | A | | 11/1990 | Clark | |
| 5,372,333 | A | | 12/1994 | Uwira et al. | |
| 5,585,557 | A | * | 12/1996 | Loschke | G01P 5/14 73/170.14 |
| 6,073,888 | A | * | 6/2000 | Gelon | B64G 1/50 165/104.22 |
| 6,329,649 | B1 | | 12/2001 | Jack et al. | |
| 2014/0117241 | A1 | | 5/2014 | Corcos et al. | |

OTHER PUBLICATIONS

International Search Report and Written Opinion for corresponding International Application No. PCT/US2017/014509 dated Apr. 24, 2017.

* cited by examiner

METHOD FOR DYNAMIC HEAT SENSING IN HYPERSONIC APPLICATIONS

FIELD OF THE INVENTION

The invention relates to a system and method for detecting surface temperatures of hypersonic vehicles.

DESCRIPTION OF THE RELATED ART

Conventional hypersonic flight vehicles are configured to include a radome that protects equipment used for operation of the flight vehicle, such as antennas. During flight of the vehicle, exterior surfaces of the radome may be subject to high temperatures that heat components within the radome. For example, temperatures may increase to greater than 2200 Kelvin at a nosetip region of the radome and greater than 1900 Kelvin around the main body of the radome. The temperatures around the radome may not be uniform such that certain regions of the radome may be subject to greater amounts of heat as compared with other regions. High surface temperatures of the flight vehicle may impact performance of the hypersonic vehicle, primarily due to overly heated surfaces and possible deformation of the vehicle body in the overheated regions.

One example of a component that may be affected by overheating is the ablator of the vehicle. Hypersonic vehicles generally include an ablator or heat shield material that is consumed during atmospheric entry to dissipate heat. If temperature of the vehicle at a surface near the ablator exceeds normal temperature capacity, ablator recession may be accelerated. Another example of an area of the vehicle that is affected by overheating is the frame or body of the vehicle. An insulation layer surrounds the body of the vehicle and is formed of tiles bonded to the body, where gaps between the tiles are used to allow for thermal expansion of the body. Hot gas from external flow around the vehicle may enter a gap and increase the heat flux on a respective side wall of the body, resulting in damage or even deformation to the body.

Prior attempts to detect and accommodate for overly heated surface areas of the vehicle and asymmetric side heating loads of the vehicle body include using various design modifications. However, the design modifications may be based on a conservative thermal analysis, as opposed to more accurate temperature readings around the vehicle. Some of the implemented design modifications have included adding weight to the vehicle by providing additional electronics or sensors in the vehicle for sensing temperatures. Adding components and weight to the flight vehicle may disadvantageously impact normal operation and function of the vehicle.

SUMMARY OF THE INVENTION

A sensor system and method for dynamic heat sensing may be implemented in a hypersonic vehicle for determining accurate and low temporal lag estimates of missile surface temperatures and adjusting vehicle operation in accordance therewith. The hypersonic vehicle contains a main antenna that is a radio-frequency (RF) antenna configured for sending and/or receiving signals. The sensor system and method includes at least one auxiliary antenna that is arranged within a region of the radome for receiving a portion of radiation that is radiated by heated surfaces of the flight vehicle. The system and method is configured to detect radiation around the radome by measuring the received infrared (IR)/optical energy in the auxiliary antenna, determine the location of an overly heated exterior surface of the radome based on the detected radiation, and rotate the flight vehicle to equalize heat distribution around the radome.

In an exemplary embodiment, the auxiliary antenna may be in the form of a plurality of single-element IR or optical antenna structures that each correspond to a particular region of the radome. Each antenna structure may have a distinctive directivity radiation pattern. In another exemplary embodiment, the auxiliary antenna may be in the form of a phased array of nano antenna structures. Each region of the radome may correspond to a particular IR or optical beam orientation, based on the location of the phased array of nano antenna structures within the radome. In still another embodiment, the auxiliary antenna may be in the form of nano IR antenna structures that are positioned on top of RF elements of the main antenna. The nano IR antenna structures may be edged or integrated onto a portion of the RF elements such that the auxiliary antenna does not interfere with operation of the main antenna.

The sensor system and method provides several advantages over prior sensor systems. One advantage is the ability to detect surface temperatures higher than 1800 Kelvin, whereas conventionally-used thermocouple sensors melt at the high temperatures. Another advantage of using the auxiliary antenna is enabling computation of surface temperatures of the vehicle with a time lag of less than a second from real time. The auxiliary antenna is particularly advantageous over conventionally-used thermocouples that have low melting temperatures, such that thermocouples must be embedded within insulation of the vehicle which effectively introduces large time lags in heat sensing. Still another advantage is packaging flexibility and functionality using the auxiliary antenna. The auxiliary antenna may be configured for performing multiple functions within the vehicle. Arranging the auxiliary antenna in the existing space of the radome also enables simple construction of the system.

According to an aspect of the invention, a heat sensing system may be implemented in a flight vehicle having a radome surrounding a main antenna configured for sending and/or receipt of a signal. The sensor system includes at least one auxiliary antenna associated with a region of the radome, the at least one auxiliary antenna being configured to receive infrared or optical energy to determine a measured temperature of the region based on the infrared or optical energy, a processor operatively coupled to the auxiliary antenna and configured to identify whether the measured temperature exceeds a predetermined temperature, and a controller operatively coupled to the at least one auxiliary antenna and the processor. The controller receives information from the processor regarding the measured temperature and the controller is configured to rotate the flight vehicle to a different orientation when the measured temperature exceeds the predetermined temperature.

According to an aspect of the invention, the at least one auxiliary antenna may include a plurality of single-element infrared or optical antenna structures arranged within the radome.

According to an aspect of the invention, the main antenna may include a plurality of radio-frequency radiating elements that correspond to the plurality of single-element infrared or optical antenna structures, each of the plurality of single-element infrared or optical antenna structures being positioned on a portion of a corresponding one of the plurality of radio-frequency radiating elements.

According to an aspect of the invention, the radome may include a plurality of regions and each of the infrared or optical antenna structures may be associated with one of the plurality of regions to detect the measured temperature of the respective region.

According to an aspect of the invention, each of the plurality of infrared or optical antenna structures may have a distinctive directivity radiation pattern.

According to an aspect of the invention, each distinctive directivity radiation pattern may be in an upward direction within the radome.

According to an aspect of the invention, the at least one auxiliary antenna may be a Yagi-Uda antenna structure.

According to an aspect of the invention, the at least one auxiliary antenna may be configured in an asymmetric spiral shape, a microstrip dipole shape, or a square spiral shape.

According to an aspect of the invention, the at least one auxiliary antenna may include a phased array of nano-antenna structures.

According to an aspect of the invention, the phased array may be rectangular in shape.

According to an aspect of the invention, the radome may be formed of a dielectric material and the at least one auxiliary antenna may be embedded in the dielectric material.

According to an aspect of the invention, a method for dynamic heat sensing may be used in a flight vehicle having a main antenna configured for sending and/or receipt of a signal and at least one auxiliary antenna arranged within the flight vehicle. The method includes using the at least one auxiliary antenna to detect a current temperature of at least one region of the flight vehicle, using a processor in communication with the auxiliary antenna to determine whether the current temperature exceeds a predetermined temperature, and rotating the flight vehicle when the current temperature exceeds the predetermined temperature.

According to an aspect of the invention, using the at least one auxiliary antenna may include using a plurality of infrared or optical antenna structures corresponding to a plurality of regions within the flight vehicle, each of the plurality of infrared or optical antenna structures positioned within one of the plurality of regions to detect the current temperature of the respective region.

According to an aspect of the invention, the method may include registering local coordinates of each of the plurality of regions, identifying a coordinate location of each of the plurality of infrared or optical antenna structures, correlating each of the plurality of infrared or optical antenna structures with a corresponding one of the plurality of regions, measuring infrared or optical energy of each of the plurality of infrared or optical antenna structures, identifying a first region of the plurality of regions that has a highest temperature of the plurality of regions, identifying a second region of the plurality of regions that has a lowest temperature of the plurality of regions, and determining a temperature difference between the first region and the second region.

According to an aspect of the invention, the method may include re-measuring the infrared or optical energy of each of the plurality of infrared or optical antenna structures when the temperature difference does not exceed a predetermined value.

According to an aspect of the invention, the method may include determining a coordinate difference between the first region and the second region when the temperature difference exceeds a predetermined value.

According to an aspect of the invention, rotating the flight vehicle may include rotating the flight vehicle by the coordinate difference between the first region and the second region.

According to an aspect of the invention, the method may include continuously monitoring the current temperature of the plurality of regions of the flight vehicle after the flight vehicle has been rotated.

According to an aspect of the invention, using the at least one auxiliary antenna may include using a phased array of nano antenna structures.

According to an aspect of the invention, the method may include registering local coordinates of each of a plurality of regions within the flight vehicle, identifying a coordinate location of the phased array of nano antenna structures, correlating at least one orientation of a beam of radiation received by each of the nano antenna structures with one of the plurality of regions, measuring infrared or optical energy arriving at a phase of the phased array, identifying a first region of the plurality of regions that has a highest temperature of the plurality of regions, identifying a second region of the plurality of regions that has a lowest temperature of the plurality of regions, determining a temperature difference between the first region and the second region, and rotating the flight vehicle by the coordinate difference when the temperature difference exceeds a predetermined temperature.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

The principles described herein have particular application in flight vehicles or hypersonic vehicles such as missiles. During hypersonic flight, the surface temperatures of the body of the hypersonic vehicle increases to temperatures that affect the performance of the vehicle. The surface temperatures may range from 600 Kelvin to temperatures greater than 1800 Kelvin. Detecting the surface temperature in nearly real time is desirable for maximizing vehicle efficiency by adjusting the vehicle operation to accommodate for overly heated surface areas of the vehicle or the surrounding environment of the hypersonic vehicle. Specific surface temperatures may indicate that the vehicle is traveling through atmospheric turbulence, such that the flight path of the vehicle or orientation of the vehicle may be adjusted to equalize heat around the vehicle. A heat sensing system may be implemented in the vehicle to detect overly heated areas of the exterior surface of the vehicle.

Figure 1:
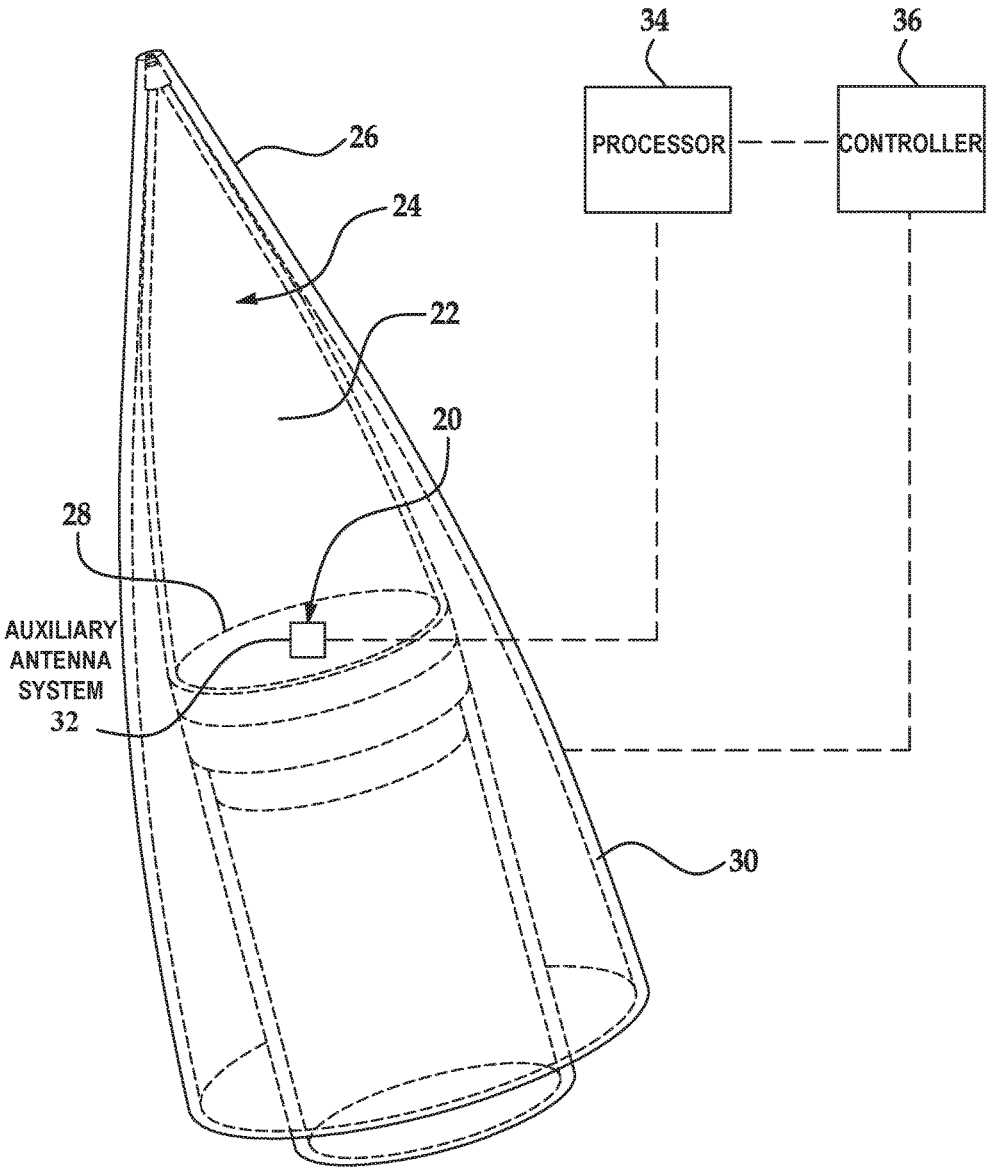
FIG. 1 is an oblique view of a flight vehicle having a radome with a main antenna in accordance with the present invention.
Figure 2:
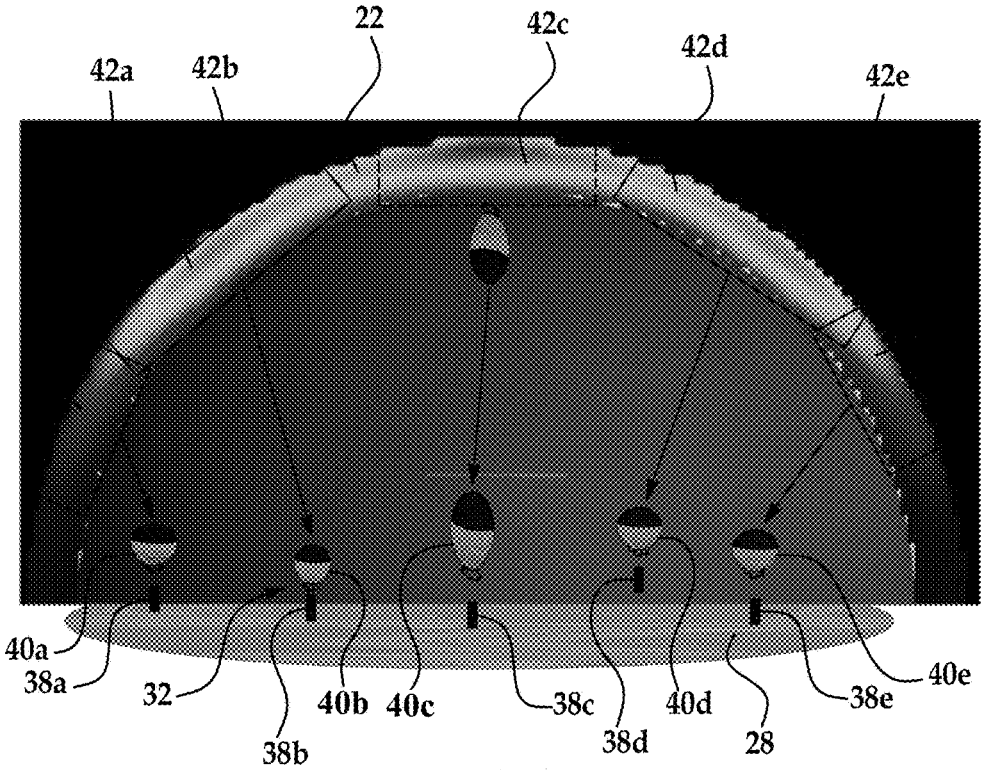
FIG. 2 is an oblique view of the radome of FIG. 1 showing a heat sensing system with an auxiliary antenna according to an exemplary embodiment of the present invention.
Figure 3:
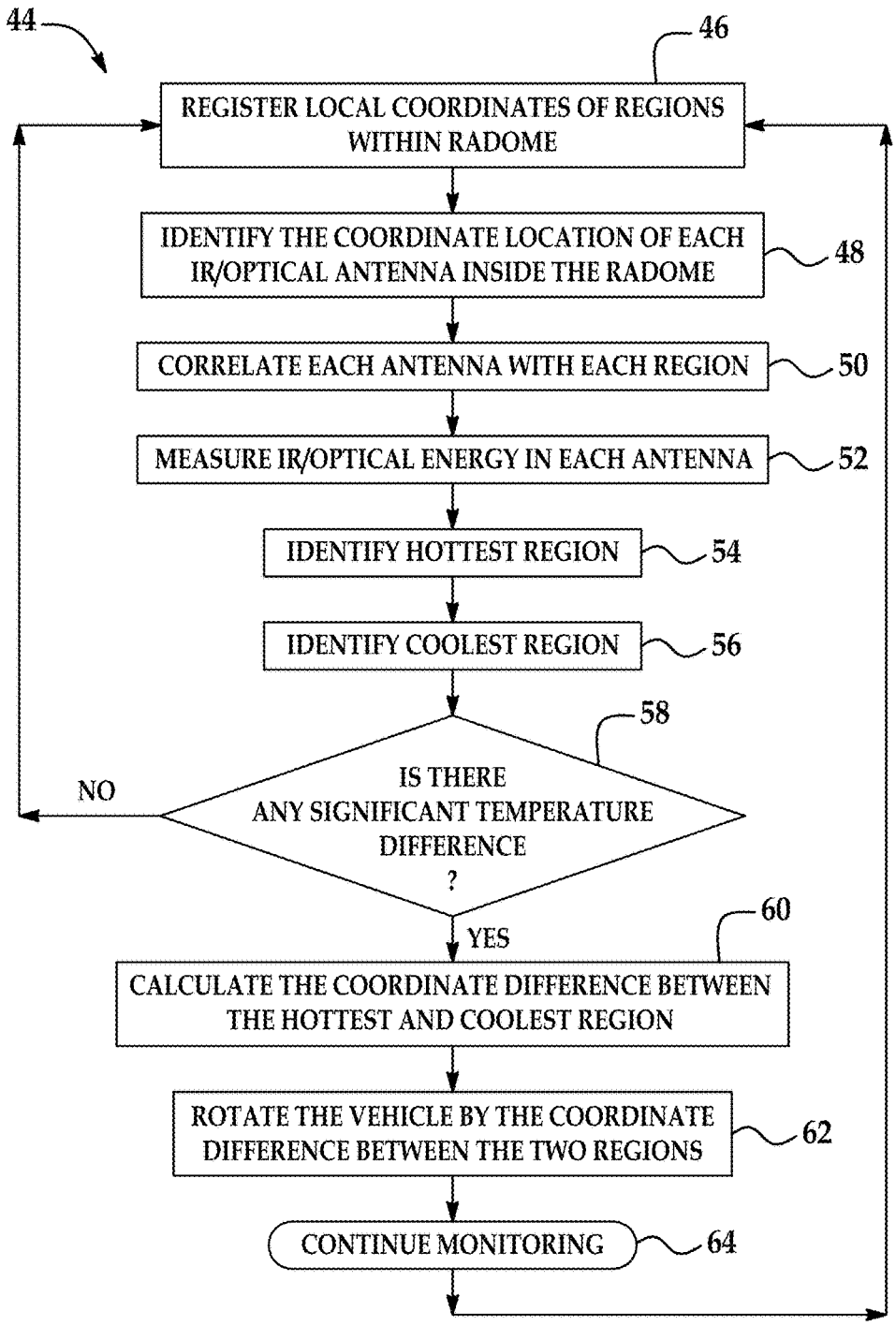
FIG. 3 is a flowchart illustrating a heat sensing method using the heat sensing system of FIG. 2.

Referring now to FIGS. 1-3, an exemplary heat sensing system 20 and method for dynamic heat sensing is shown. As shown in FIG. 1, the heat sensing system 20 may be contained in a radio-frequency radome 22 located at the nose end 24 of a flight vehicle 26. The vehicle 26 may be a flight vehicle, such as a high-speed aircraft, ballistic missile, or spacecraft. The vehicle 26 may travel at high speeds of over 3000 meters per second. The radome 22 covers the heat sensing system 20 and protects the system 20 from environmental conditions and mechanical stresses. The radome 22 may be conically-shaped and formed of any suitable material for withstanding aerodynamic heating and mechanical stresses. Examples of suitable materials include polymeric matrix composites, ceramic matrix composites, and monolithic ceramic materials. The radome 22 may also be substantially transparent so as to let pass through radio-frequency radiation over broadband or narrowband frequencies that may be in high frequency ranges between 3 gigahertzes and 30 gigahertzes.

The radome 22 may contain a main antenna 28 that may provide various functions for the vehicle 26 during flight, such as acting as a radar or a global positioning system. The main antenna 28 may be a radio-frequency (RF) antenna and may be configured to send and/or receive signals at radio frequencies. The main antenna 28 may also be used for target detection. In an exemplary configuration of the main antenna 28, the main antenna 28 may be cylindrical, or disc-shaped. An exterior surface 30 of the radome 22 may be subject to radiation during normal operation of the vehicle 26 such that portions of the exterior surface 30 may become overly heated. Heat may be distributed unevenly along the exterior surface 30 such that portions of the exterior surface 30 that are closer to the tip of the nose end 24 of the radome 122 may be hotter than portions further away from the nose end 24. For example, surface temperatures at the tip may be greater than 1700 Kelvin, whereas surface temperatures at areas of the radome 22 that are further away from the tip may range between 600 and 1000 Kelvin.

The heat sensing system 20 may include at least one auxiliary antenna or an auxiliary antenna system 32 that is configured within the radome 22 and operable as a sensor. The auxiliary antenna system 32 may be configured within the radome 22 or may be positioned at any suitable location around the vehicle 26. The auxiliary antenna system 32 may be in a passive mode, such that the auxiliary antennas do not transmit signals as in the operation of the main antenna 28. The auxiliary antenna system 32 may be used to receive infrared (IR) or optical energy and measure the received IR or optical energy. The auxiliary antenna system 32 may include auxiliary antennas having any suitable antenna structure. For example, the auxiliary antenna system 32 may include IR or optical antenna elements that are operable at IR or optical frequencies. The IR or optical antenna elements may receive a portion of radiation from the exterior surface 30 of the radome 22. The auxiliary antenna system 32 may be suitable for use with visible or infrared light. Using the auxiliary antenna system 32 is advantageous in that the auxiliary antenna system 32 may have various characteristics such as light detection, directional responsiveness in point detection, tunability, and relatively quick response times. The auxiliary antenna system 32 is configured to detect a temperature of at least one region within the radome 22 to determine the temperature of a corresponding portion of the exterior surface 30.

The heat sensing system 20 may include a processor 34 that is operatively coupled to the auxiliary antenna system 32 and configured to identify whether the measured temperatures detected by the auxiliary antenna system 32 exceed a predetermined temperature. A controller 36 may be operatively coupled to the auxiliary antenna system 32 and the processor 34. The controller 36 receives information from the processor 34 regarding the measured temperatures of the regions of the radome 22 and the controller 36 is configured to rotate the flight vehicle 26 to a different orientation when a measured temperature exceeds the predetermined temperature.

Referring in addition to FIG. 2, an exemplary embodiment of the auxiliary antenna system 32 is shown. The auxiliary antenna system 32 may be arranged within the radome 22 and positioned around a region of the main antenna 28. The auxiliary antenna system 32 may be in the form of IR or nano-optical antenna structures 38*a*, 38*b*, 38*c*, 38*d*, 38*e* that are tuned to operate around IR or optical frequencies. Each of the IR/nano-optical antenna structures 38*a*, 38*b*, 38*c*, 38*d*, 38*e* may be in the form of a single-element antenna structure and each antenna structure 38*a*, 38*b*, 38*c*, 38*d*, 38*e* may have an individual or distinctive directivity radiation pattern 40*a*, 40*b*, 40*c*, 40*d*, 40*e*. The directivity of the antenna structures is a measure of the power density that the antenna radiates in a direction of its strongest emission. As shown in FIG. 2, each distinctive directivity radiation pattern 40*a*, 40*b*, 40*c*, 40*d*, 40*e* may be in an upward direction within the radome 22. Using an IR or nano-optical antenna structure is particularly advantageous due to the directivity of each antenna structure.

Each antenna structure 38*a*, 38*b*, 38*c*, 38*d*, 38*e* may be configured within a different region of the radome 22 that corresponds to a region 42*a*, 42*b*, 42*c*, 42*d*, 42*e* of the exterior surface 30 of the radome 22. The radome 22 may be formed of a dielectric material and the IR or nano-optical antenna structures 38*a*, 38*b*, 38*c*, 38*d*, 38*e* may be embedded in the dielectric material. Each antenna structure 38*a*, 38*b*, 38*c*, 38*d*, 38*e* may be configured to detect the temperature of the respective region 42*a*, 42*b*, 42*c*, 42*d*, 42*e*. In an exemplary arrangement of the auxiliary antenna system 32, the auxiliary antenna system 32 may include four or five IR or nano-optical antenna structures and the radome 22 may be divided into four or five regions. The number of regions of the radome 22 may correspond to the number of antenna structures used. Any suitable number of antenna structures may be used and the radome 22 may be divided into any suitable number of regions.

Referring in addition to FIG. 3, a flow chart illustrating a heat sensing method 44 is shown. The heat sensing method 44 may implement the auxiliary antenna system 32 of FIG. 2. Step 46 of the heat sensing method 44 includes registering local coordinates of the regions 42*a*, 42*b*, 42*c*, 42*d*, 42*e* of the radome 22, as shown in FIG. 2. The processor 34 of the heat sensing system 20 may be configured to register the local coordinates of the regions 42*a*, 42*b*, 42*c*, 42*d*, 42*e*. Step 48 of the heat sensing method 44 includes identifying the coordinate location of each IR or optical antenna structure 38*a*, 38*b*, 38*c*, 38*d*, 38*e* inside the radome 22 and step 50 includes correlating each IR or optical antenna structure 38*a*, 38*b*, 38*c*, 38*d*, 38*e* with a respective region 42*a*, 42*b*, 42*c*, 42*d*, 42*e*, based on the identified coordinates. The processor 34 may also be configured to identify the coordinate locations and correlate the antenna structures with the respective region of the radome 22.

After the antenna structures 38*a*, 38*b*, 38*c*, 38*d*, 38*e* are correlated with the respective region 42*a*, 42*b*, 42*c*, 42*d*, 42*e*, step 52 of the method 44 includes measuring the IR or optical energy in each IR or optical antenna structure 38*a*, 38*b*, 38*c*, 38*d*, 38*e*. Each antenna structure 38*a*, 38*b*, 38*c*, 38*d*, 38*e* may have a different IR or optical energy and the IR or optical energy may be of an electromagnetic nature, as in radio frequencies. In the IR or optical case, higher frequencies may be used, as compared to radio frequencies. At the IR frequencies, the nano-antenna structures may be used to match the IR or optical frequencies that are related to temperature and hot body radiation of the vehicle 26. Using the nano-optical antenna structures is advantageous due to the high directivity of the structures such that the measured IR or optical energy may be used to determine a current temperature of the respective region 42*a*, 42*b*, 42*c*, 42*d*, 42*e* of the radome 22.

After the current temperatures of the regions 42*a*, 42*b*, 42*c*, 42*d*, 42*e* are measured by the auxiliary antenna system 32, the processor 34 is in communication with the auxiliary antenna system 32 to determine whether the current temperatures exceed a predetermined temperature. Step 52 of the method 44 includes identifying the hottest region of the regions 42*a*, 42*b*, 42*c*, 42*d*, 42*e* and step 56 includes identifying the coolest region of the regions 42*a*, 42*b*, 42*c*, 42*d*, 42*e*. As shown in FIG. 2, the hottest region may be the region located in a centermost location of the radome 22, or region 42*c*, such that the associated antenna structure 38*c* registers the highest received IR radiation. The cooler regions may be the regions located furthest from the centermost location of the radome 22, such as regions 42*a* and 42*e*. The hottest and coolest regions will vary depending on the shape of the radome 22 and operation of the flight vehicle 26. After the hottest and coolest regions have been identified, step 58 of the method 44 includes determining whether a significant temperature difference exists between the hottest region and the coolest region. If the temperature difference exceeds a predetermined temperature, step 60 includes calculating the coordinate difference between the hottest and coolest region. After the coordinate difference has been calculated by the processor 34, step 62 includes rotating the flight vehicle 26 by the coordinate difference. The flight vehicle 26 may be rotated by way of the controller 36 that is in communication with the processor 34.

If the processor 34 determines that a significant temperature difference between the hottest region and the coolest region does not exceed the predetermined temperature, the heat sensing system 20 may be configured to return to step 46 of registering the local coordinates of the regions 42*a*, 42*b*, 42*c*, 42*d*, 42*e* within the radome 22. The method 44 may be a continuous loop such that the temperatures around the radome 22 are continuously monitored by the heat sensing system 20 and the flight vehicle 26 is rotated only when the temperature difference between the hottest region and the coolest region exceeds the predetermined temperature. After the flight vehicle 26 has been rotated, step 64 of the method 44 includes continuously monitoring the current temperatures of the regions 42*a*, 42*b*, 42*c*, 42*d*, 42*e*, as shown in FIG. 3.

Figure 4A:
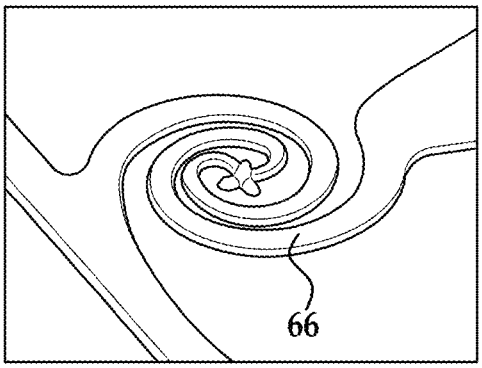
FIG. 4A is an oblique view of a scanning electron microscope image showing an exemplary embodiment of the auxiliary antenna of FIG. 2.
Figure 4B:
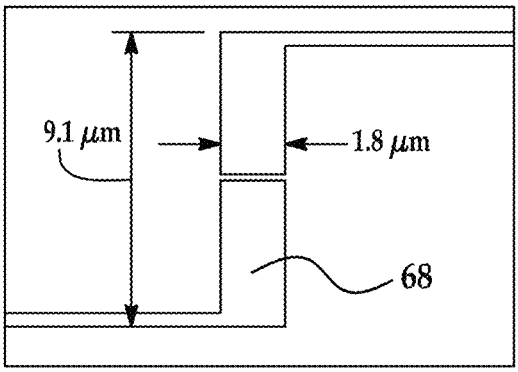
FIG. 4B is an oblique view of a scanning electron microscope image showing a second exemplary embodiment of the auxiliary antenna of FIG. 2.
Figure 4C:
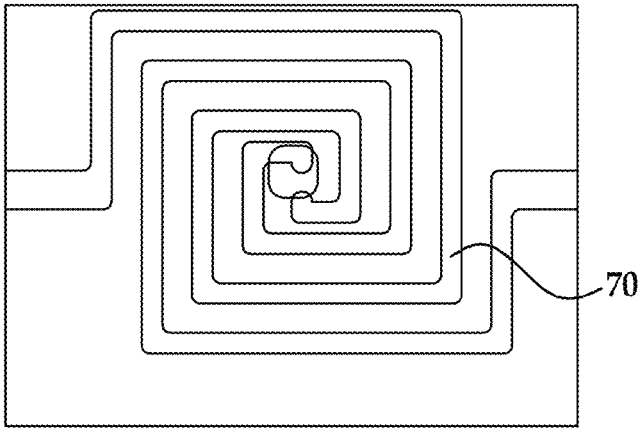
FIG. 4C is an oblique view of a scanning electron microscope image showing a third exemplary embodiment of the auxiliary antenna of FIG. 2.

Referring now to FIGS. 4A-D, exemplary embodiments of the IR or optical antenna structures 38*a*, 38*b*, 38*c*, 38*d*, 38*e* are shown. FIGS. 4A-C show scanning electron microscope images of exemplary antenna structures. As shown in FIG. 4A, the IR/nano-optical antenna structures may be shaped in the form of an asymmetric spiral 66. As shown in FIG. 4B, the IR or optical antenna structures may be shaped in the form of a microstrip dipole 68. As shown in FIG. 4C, the IR or optical antenna structures may be shaped in the form of a square spiral 70. The embodiments shown are examples of suitable antenna configurations and the IR or optical antenna structures 38*a*, 38*b*, 38*c*, 38*d*, 38*e* may be dimensioned or configured in any suitable arrangement. For example, other suitable configurations may include bow-tie antenna structures or arrays of monopole antenna structures.

Figure 4D:
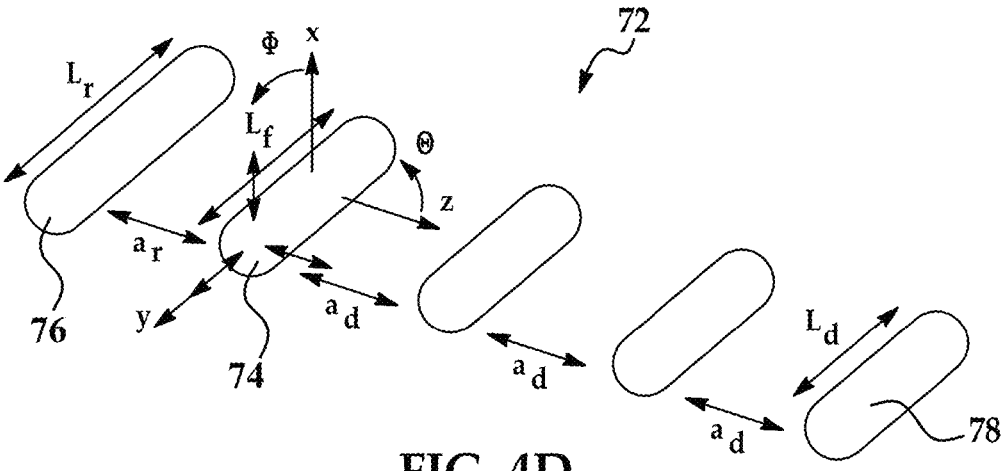
FIG. 4D is an oblique view of the auxiliary antenna of FIG. 2 showing a Yaki antenna configuration.

As shown in FIG. 4D, another exemplary configuration of the IR or optical antenna structures includes each antenna structure being in the form of a Yagi-Uda nano optical antenna, or Yaki antenna 72 that is horizontally or vertically polarized. The Yaki antenna 72 may include a feed element 74 that is coupled to a reflector 76 and a plurality of directors 78. The reflector 76 and the directors 78 are parasitic elements that control the directivity or gain of the Yaki antenna 72. In an exemplary embodiment, the Yaki antenna 72 includes three directors, but the directivity or gain may be increased by adding parasitic elements. For example, the Yaki antenna 72 may be configured to include five directors. The directors 78 may be spaced from the feed element 74 and from the other directors 78 equidistantly by an amplitude $a_d$. The reflector 76 may be spaced from the feed element 74 by an amplitude $a_r$ that is less than the amplitude $a_d$. In an exemplary embodiment, the Yaki antenna 72 may be operable at a frequency of 570 nanometers and the total length of the antenna may be between 500 and 600 nanometers. The amplitude ad may be 0.025 wavelengths and the amplitude $a_r$ may be 0.22 wavelengths. The length $L_f$ of the feed element 74 may be around 160 nanometers, the length $L_d$ of the directors 78 may be around 144 nanometers, and the length $L_r$ of the reflector 76 may be around 200 nanometers. The structure of the Yaki antenna 72 may be similar to the structure of a Yaki antenna that is conventionally used at radio frequencies.

Figure 5A:
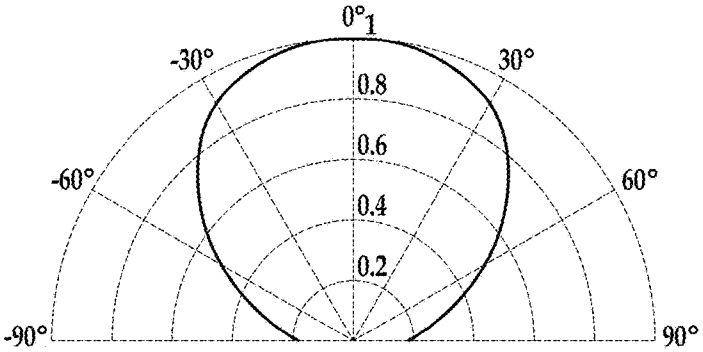
FIG. 5A is a graph showing the directivity pattern of a single dipole auxiliary antenna.
Figure 5B:
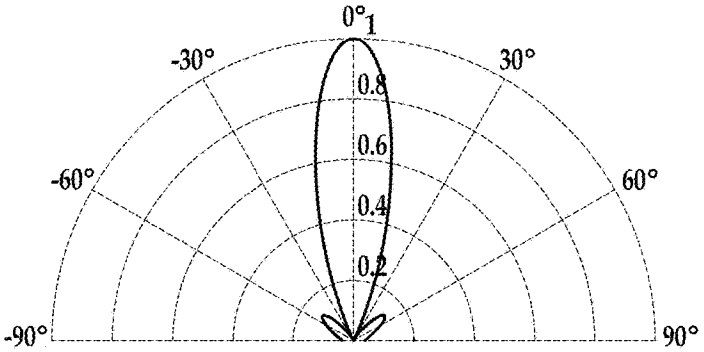
FIG. 5B is a graph showing the directivity pattern of a two dipole auxiliary antenna.
Figure 5C:
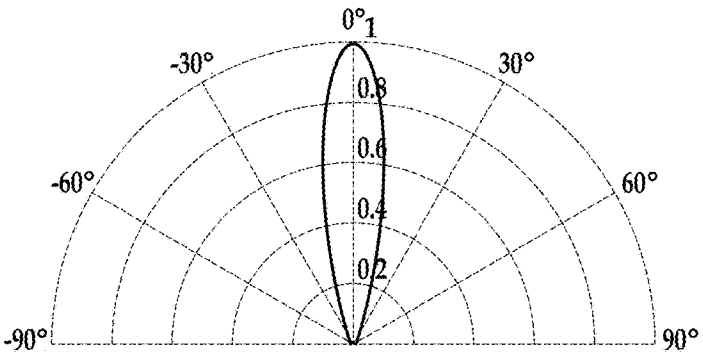
FIG. 5C is a graph showing the directivity pattern of a four dipole auxiliary antenna.
Figure 5D:
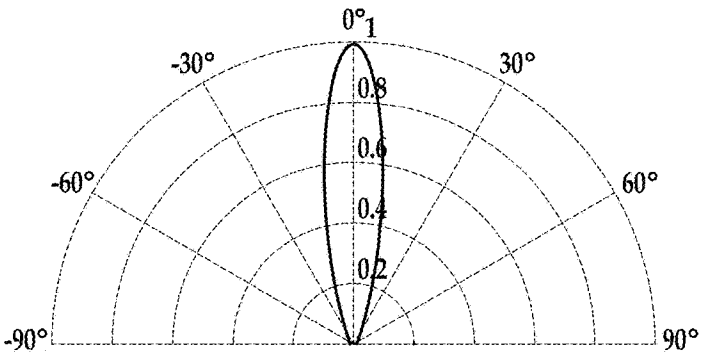
FIG. 5D is a graph showing the directivity pattern of a six dipole auxiliary antenna.
Figure 6:
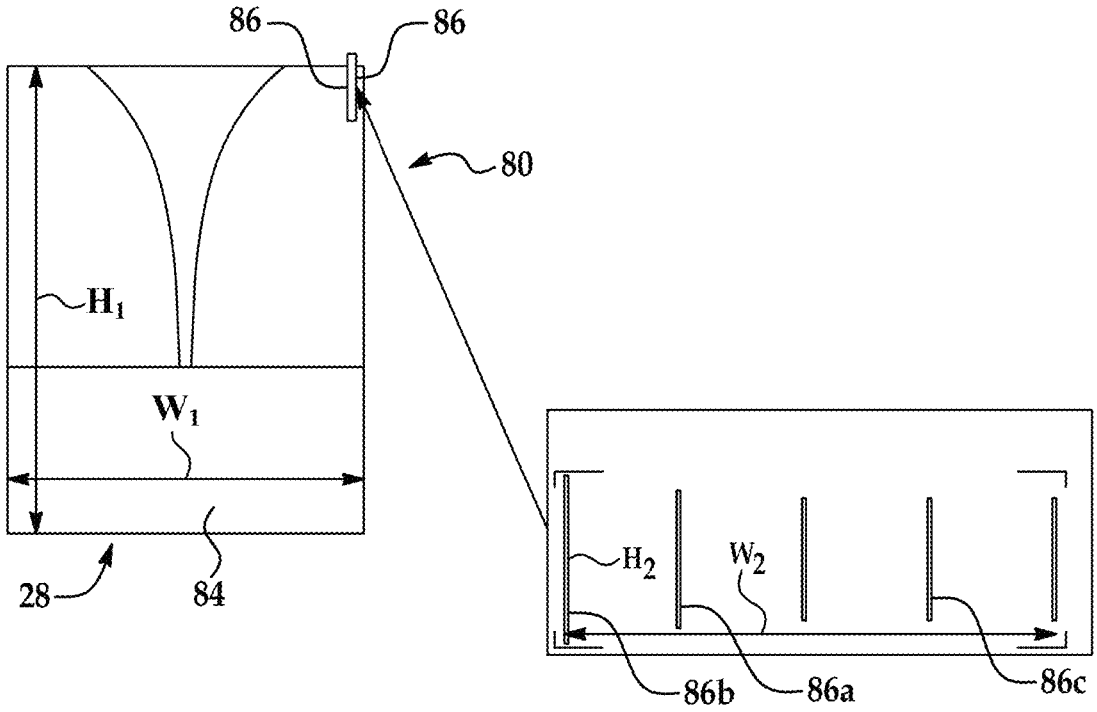
FIG. 6 is an oblique view of the main antenna of FIG. 1 showing a radio-frequency element with a corresponding auxiliary antenna.
Figure 7:
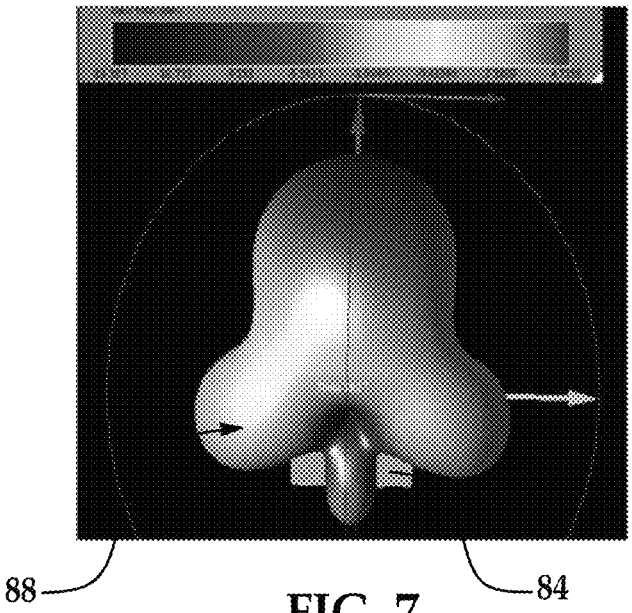
FIG. 7 is an oblique view of a radiation pattern of the main antenna of FIG. 6.

Referring now to FIGS. 5A-D, the auxiliary antenna structure may be selected to obtain a particular directivity pattern of received radiation by the antenna structure. The directivity pattern may be determined by the number of auxiliary antenna elements. As shown in each configuration of FIGS. 5A-D, the radiation direction is in an upward direction. FIG. 5A is a graph showing the directivity pattern of a single element, or single dipole auxiliary antenna. FIG. 5B is a graph showing the directivity pattern of a two dipole auxiliary antenna. FIG. 5C is a graph showing the directivity pattern of a four dipole auxiliary antenna. FIG. 5D is a graph showing the directivity pattern of a six dipole auxiliary antenna. As shown in FIGS. 5A-D, the radiation beam width of the antenna may be inversely proportional to the number of antenna elements, such that the width may decrease as the number of antenna elements increases and the width may increase as the number of antenna elements decreases. The beam width is also inversely proportional to the directivity of the phased array antenna structure such that a narrower beam width corresponds to an increased directivity.

Figure 8:
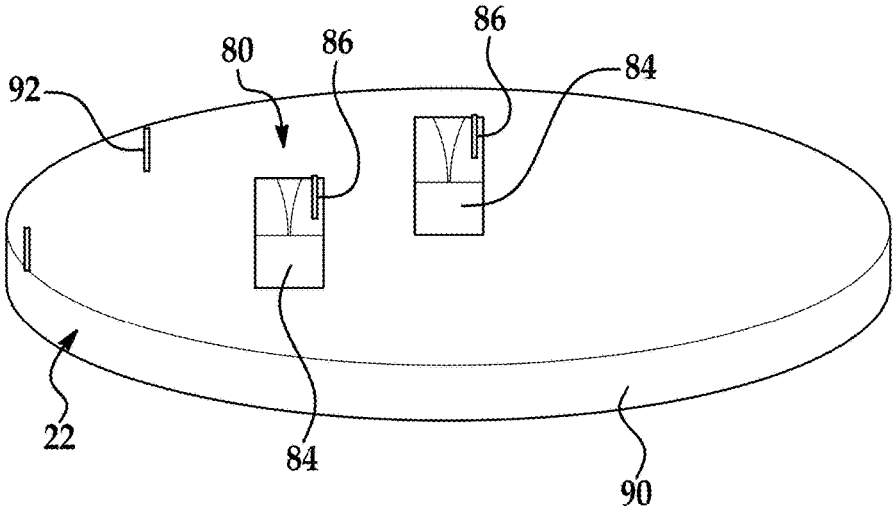
FIG. 8 is an oblique view of a heat sensing system showing a plurality of radio-frequency elements and a corresponding plurality of auxiliary antennas.
Figure 9:
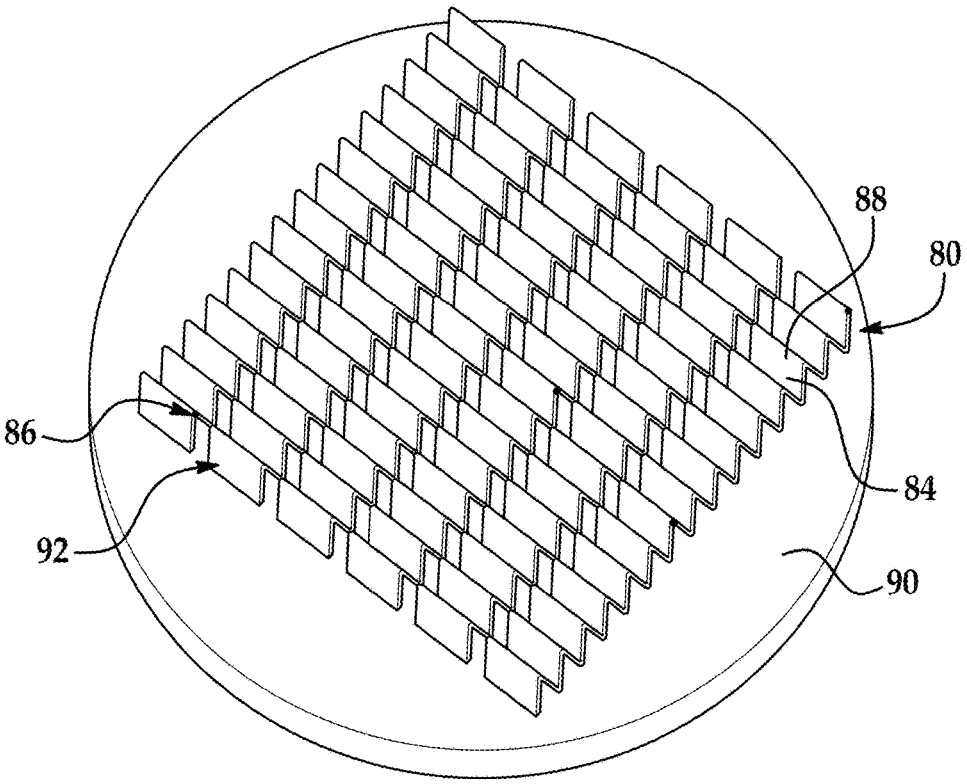
FIG. 9 is an oblique view of the heat sensing system of FIG. 8 showing an array of radio-frequency elements with integrated auxiliary antennas.
Figure 10:
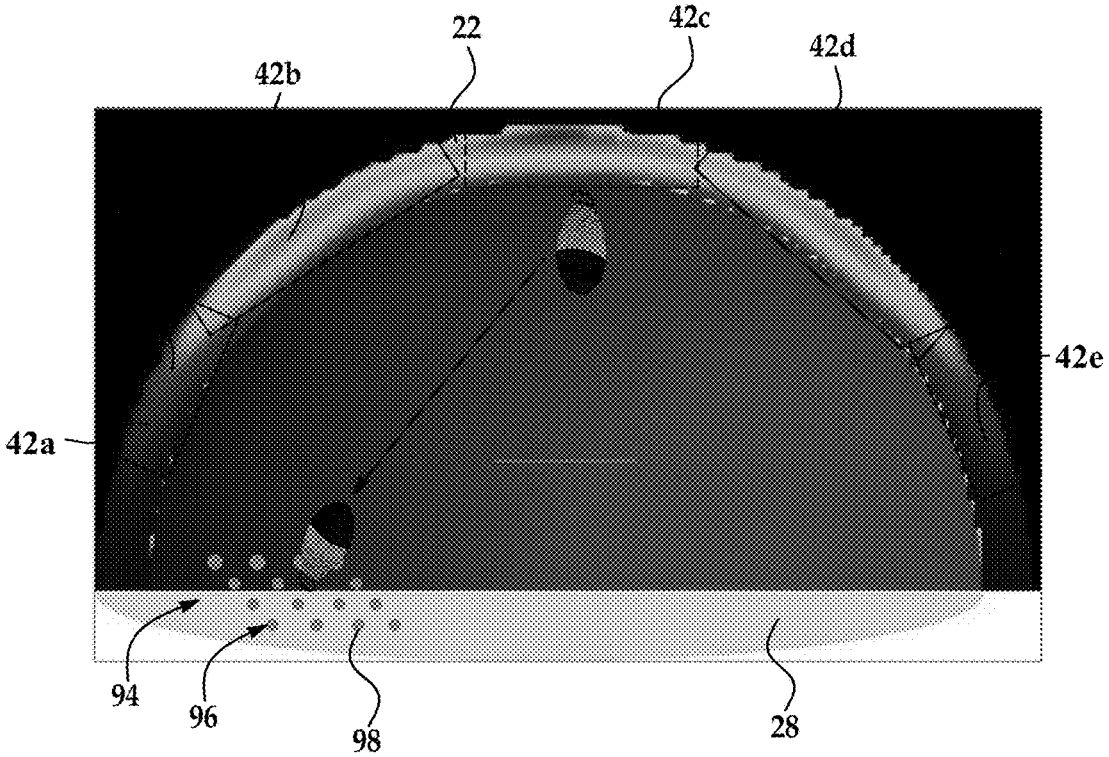
FIG. 10 is an oblique view of the radome of FIG. 1 showing a heat sensing system with an auxiliary antenna according to another exemplary embodiment of the present invention.

Referring now to FIGS. 6-9, another exemplary auxiliary antenna system 80 is shown. The main antenna 28 may include at least one RF radiating element 84. The RF radiating element 84 may have a width $W_1$ of around 2 centimeters and a height $H_1$ of around 4 centimeters, or the RF radiating element 84 may have any suitable dimensions. The auxiliary antenna system 80 may be in the form of at least one nano IR antenna 86 that is integrated or edged on a top portion 88 of the RF radiating element 84. The nano IR antenna 86 may be small relative to the RF radiating element 84 such that the nano IR antenna 86 does not interfere with the function of the RF radiating element 84. In an exemplary embodiment, the nano IR antenna 86 may have a width $W_2$ of around 562 nanometers and a height $H_2$ of around 200 nanometers, but any suitable dimensions may be used. The nano IR antenna 86 may have any suitable antenna structure. An example of a suitable antenna structure is a Yaki antenna structure having a directivity as previously described. As shown in FIG. 9, in the Yaki configuration, the nano IR antenna 86 may include a feed element 86*a*, reflector 86*b*, and directors 86*c*. As best shown in FIG. 10, the orientation of a radiation pattern 88 of the RF radiating element 84 may be in an upward direction. The operating frequency of the RF radiating element 84 may be 2 gigahertz and higher while the operating frequency of the nano IR antenna 86 may be greater than 500 terahertz.

As shown in FIG. 8, the auxiliary antenna system 80 may include a plurality of nano IR antennas 86 that are positioned on the RF radiating elements 84 of the main antenna. The main antenna may be in the form of Vivaldi antenna structures or Vivaldi arrays, but any suitable antenna structure may be used. The RF radiating elements 84 may be arranged perpendicularly relative to a base 90 of the radome 22. The auxiliary antenna system 80 may additionally include a plurality of nano IR antennas 92 that are positioned around the base 90 of the radome 22. As shown in FIG. 9, the base 90 may include an array 92 of RF radiating elements 84. The array 92 may be a rectangular array or an array having any suitable shape. At least one of the RF radiating elements 84 may include the nano IR antenna 86 integrated or edged on the top portion 88 of the RF radiating element 84. As shown in FIG. 9, a plurality of RF radiating elements 84 may include the nano IR antennas 86 and each of the nano IR antennas 86 may point in an upward direction within the radome 22. The nano IR antennas 86 are shown pointing in the upward direction, but in another exemplary embodiment, the nano IR antennas 86 may be configured to extend sideways from the RF radiating elements 84. In an exemplary configuration, the radome 22 may include more RF radiating elements 86 than IR antennas 86.

Figure 11:
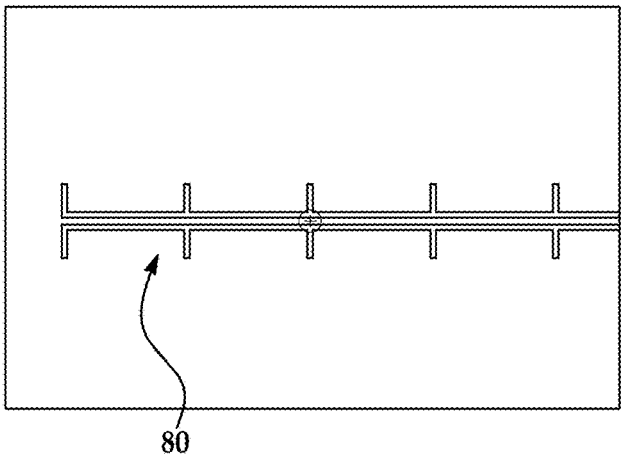
FIG. 11 is an oblique view of a scanning electron microscope image showing the auxiliary antenna of FIG. 10.
Figure 12A:
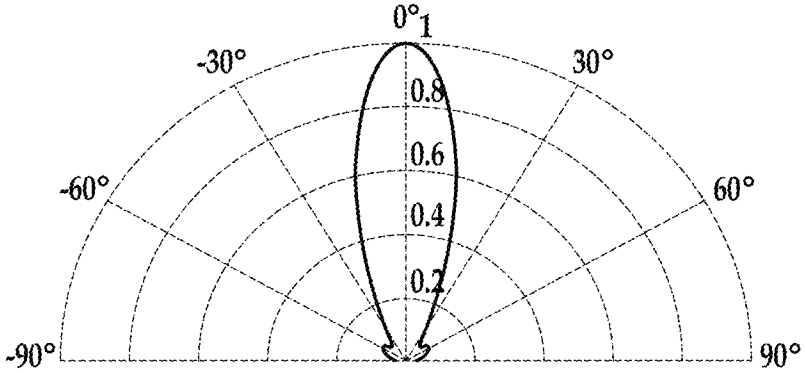
FIG. 12A is a graph of a radiation beam orientation associated with a first region of the radome.
Figure 12B:
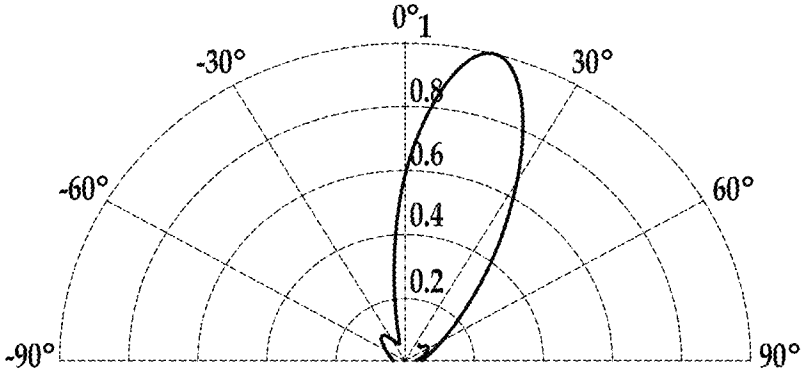
FIG. 12B is a graph of a radiation beam orientation associated with a second region of the radome.
Figure 12C:
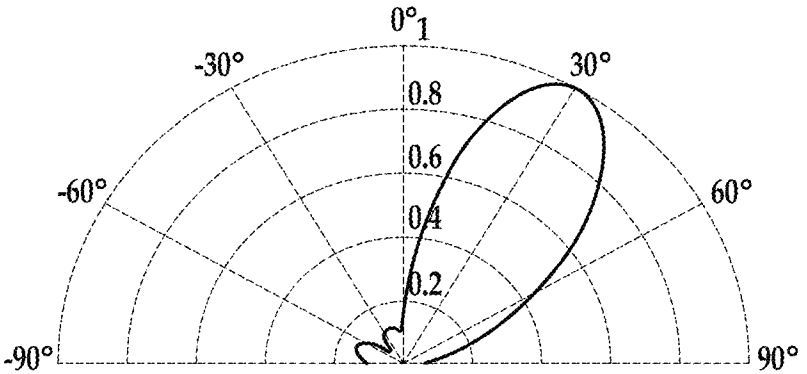
FIG. 12C is a graph of a radiation beam orientation associated with a third region of the radome.
Figure 12D:
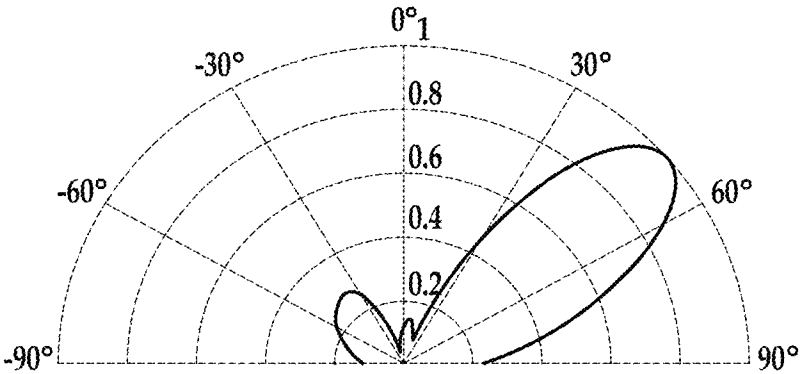
FIG. 12D is a graph of a radiation beam orientation associated with a fourth region of the radome.

Referring now to FIGS. 10-13, still another exemplary auxiliary antenna system 94 and method of heat sensing is shown. The system and method may implement a phased array 96 of nano antenna elements 98 as the auxiliary antenna system 94. The phased array 96 may be in a passive mode and configured to receive and measure IR or optical energy that is of an electromagnetic nature. As shown in FIG. 10, the phased array 96 may be arranged within the radome 22 and near a region of the main antenna 28. The phased array 96 may be in a rectangular arrangement, as shown in FIG. 10, or in any other suitable arrangement. The radome 22 may be divided into the plurality of regions 42*a*, 42*b*, 42*c*, 42*d*, 42*e* as previously described and the phased array 96 may be configured to scan each region. Each region 42*a*, 42*b*, 42*c*, 42*d*, 42*e* may be associated with a distinctive radiation beam orientation based on the location of the phased array 96 within the radome 22. As opposed to the IR or optical antenna structures previously described, where the directivity of each antenna structure is known, the phase difference between each antenna element 98 of the phased array 96 may be predetermined such that the radiation beam is directed in a particular orientation that is correlated to the plurality of regions 42*a*, 42*b*, 42*c*, 42*d*, 42*e*. In an alternative configuration where the phase is not predetermined, the phased array 96 may be configured for beamforming. FIG. 11 is a scanning electron microscope image of the phased array 96 of nano antenna elements 98.

Referring now to FIGS. 12A-D, various radiation beam orientations are shown. Each beam orientation, or angle of arrival of the radiation are associated with each of the regions 42*a*, 42*b*, 42*c*, 42*d*, 42*e*. For example, the beam orientation shown in FIG. 12A may correspond to the region 42*c* and the beam orientation shown in FIG. 12D may correspond to the region 42*d*, as shown in FIG. 10. The beam orientation shown in FIGS. 12A-D is located in an x-direction. In an arrangement where the energy of a rectangular plane, or an x-y plane is to be measured and detected by the phased array 96, the phased array 96 may be in a rectangular configuration.

Figure 13:
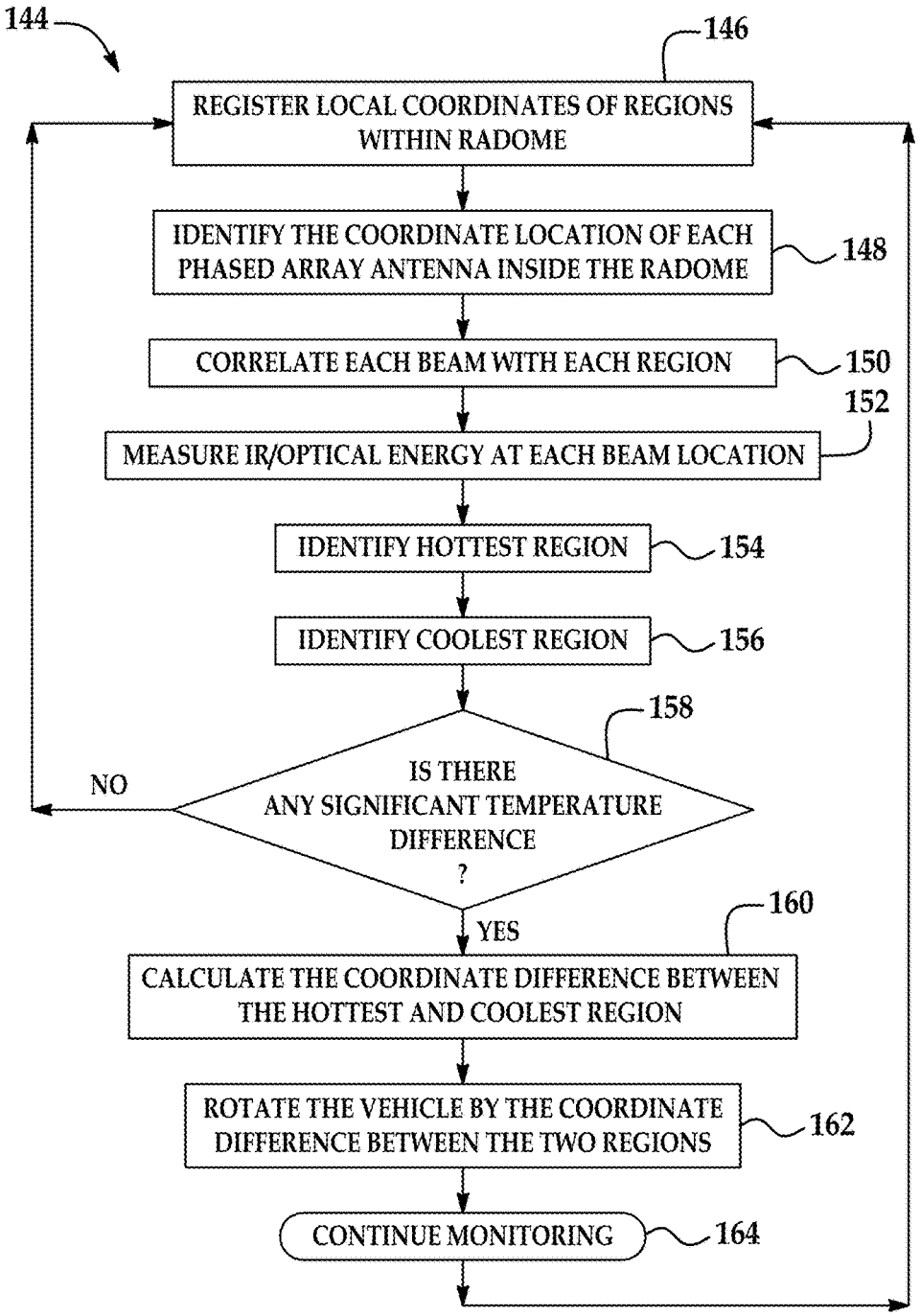
FIG. 13 is a flowchart illustrating a heat sensing method using the auxiliary antenna of FIG. 10.

Referring in addition to FIG. 13, a flow chart illustrating a heat sensing method 144 using the phased array 96 is shown. The heat sensing method 144 may be similar to the heat sensing method 44 that is previously described. Step 146 of the heat sensing method 144 includes registering local coordinates of the regions 42*a*, 42*b*, 42*c*, 42*d*, 42*e* of the radome 22 and step 148 includes identifying the coordinate location of each phased array 96 inside the radome 22. The phased array 96 may be configured for real time scanning of the regions 42*a*, 42*b*, 42*c*, 42*d*, 42*e*. After the coordinates are determined, step 150 includes correlating radiation beam orientations with a respective region 42*a*, 42*b*, 42*c*, 42*d*, 42*e*. Each beam orientation may correlate to a pre-determined phase difference between two of the antenna elements 98. After the beam orientations are correlated to the respective region 42*a*, 42*b*, 42*c*, 42*d*, 42*e*, step 152 includes measuring the IR or optical energy at each beam or phase of the phased array 96. The phased array 96 may be configured to measure the angle of arrival of the maximum received IR energy and the minimum received IR energy. By measuring the phase of the phased array 96 and the magnitude of the received IR energy, the maximum received IR energy may be identified from a specific direction, such as from the corresponding region 42*a*, 42*b*, 42*c*, 42*d*, 42*e* of the radome 22.

After the IR or optical energy has been measured, step 154 includes identifying the hottest region and step 156 includes identifying the coolest region, based on the maximum and minimum received IR energy measured by the phased array 96. After determining the hottest and coolest regions, step 158 includes determining whether a significant temperature difference exists and if the temperature difference exceeds a predetermined temperature, step 160 includes calculating the coordinate difference between the hottest and coolest region. After the coordinate difference has been calculated, step 162 includes rotating the flight vehicle by the coordinate difference. If the temperature difference between the hottest region and the coolest region does not exceed the predetermined temperature, the steps are repeated such that the method 144 is a continuous monitoring loop. If the flight vehicle is rotated, step 164 includes continuously monitoring the current temperatures of the regions 42*a*, 42*b*, 42*c*, 42*d*, 42*e*.

Figure 14:
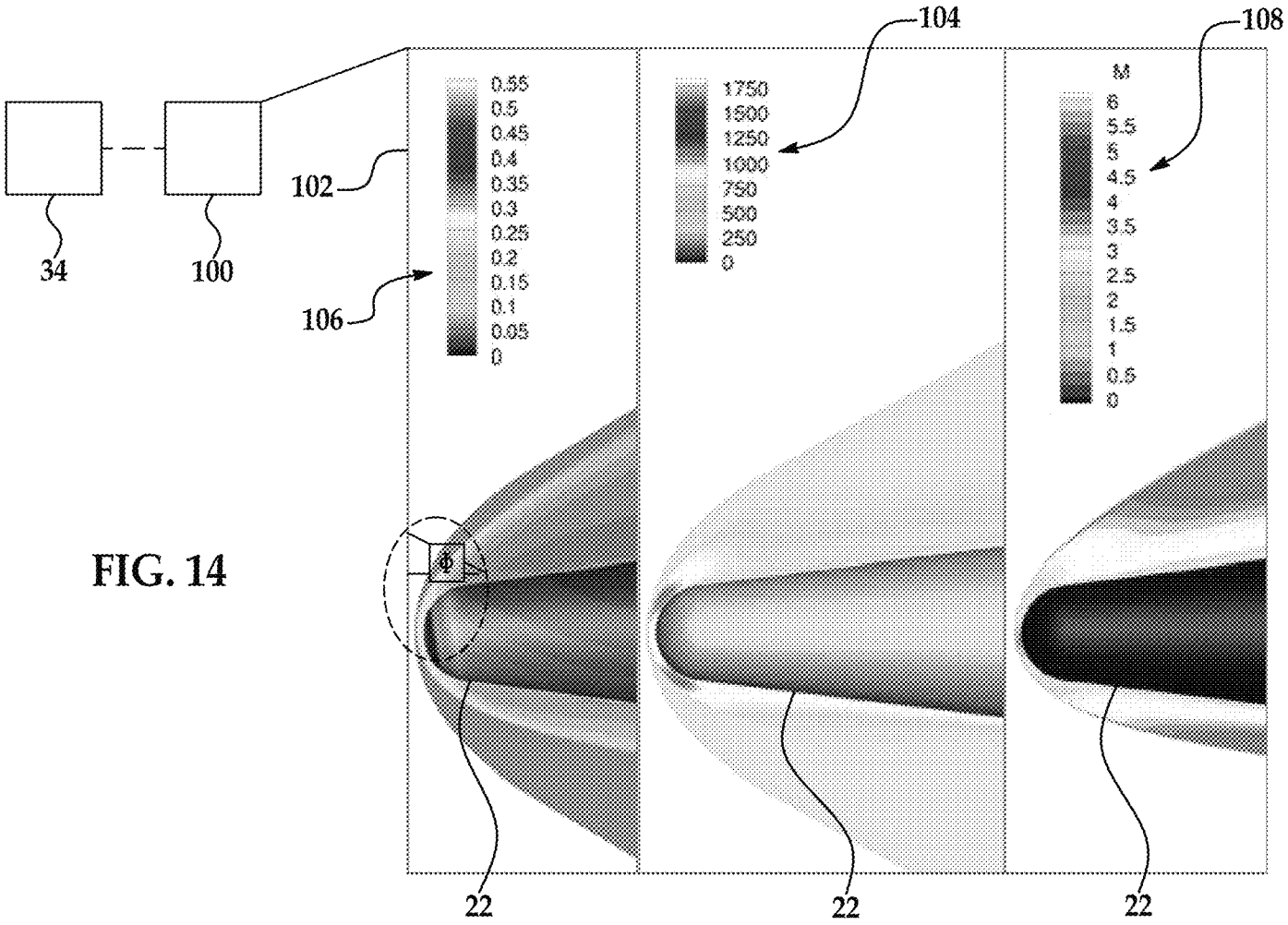
FIG. 14 is a chart showing data corresponding to the radome that may be calculated using the sensor system and method described herein.

Referring now to FIG. 14, in addition to detecting the surface temperatures around the radome 22, the angle of arrival as determined by the auxiliary antenna system 94 may be used to estimate other data for the flight vehicle, such as the density of the plasma field at the exterior surface 22, the Mach number, or the Reynolds number of the vehicle 16. The processor 36 may include a database 100 that contains a lookup table 102. The lookup table 102 may include data correlated to a specific angle of arrival Φ and may be pre-generated through electromagnetic simulation and modeling software. Providing the lookup table 102 may be advantageous in lieu of providing thermal sensors in addition to the auxiliary antenna system 94, such as in the event that the thermal sensors are inoperable during flight of the vehicle. An illustration of an exemplary lookup table 102 is schematically shown in FIG. 13. For example, a set of data 104 may correlate to estimating the temperature at an area on the exterior surface of the radome 22 based on the determined angle of arrival Φ, as previously described. Another set of data 106 may correlate to determining thermal behavior of the environment surrounding the radome 22. Still another set of data 108 may correlate to determining the Mach number based on the detected angle of arrival Φ.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A heat sensing system in a flight vehicle having a radome surrounding a main antenna configured for sending and/or receipt of a signal, the sensor system comprising:

at least one auxiliary antenna associated with a region of the radome, the at least one auxiliary antenna being configured to receive infrared or optical energy to determine a measured temperature of the region based on the infrared or optical energy;

a processor operatively coupled to the auxiliary antenna and configured to identify whether the measured temperature exceeds a predetermined temperature; and a controller operatively coupled to the at least one auxiliary antenna and the processor, wherein the controller receives information from the processor regarding the measured temperature; and wherein the controller is configured to rotate the flight vehicle to a different orientation when the measured temperature exceeds the predetermined temperature.

2. The heat sensing system according to claim 1, wherein the at least one auxiliary antenna includes a plurality of single-element infrared or optical antenna structures arranged within the radome.

3. The heat sensing system according to claim 2, wherein the at least one auxiliary antenna includes at least four single-element infrared or optical antenna structures.

4. The heat sensing system according to claim 2, wherein the main antenna includes a plurality of radio-frequency radiating elements that correspond to the plurality of single-element infrared or optical antenna structures, each of the plurality of single-element infrared or optical antenna structures being positioned on a portion of a corresponding one of the plurality of radio-frequency radiating elements.

5. The heat sensing system according to claim 2, wherein the radome includes a plurality of regions and each of the infrared or optical antenna structures is associated with one of the plurality of regions to detect the measured temperature of the respective region.

6. The heat sensing system according to claim 2, wherein each of the plurality of infrared or optical antenna structures has a distinctive directivity radiation pattern.

7. The heat sensing system according to claim 6, wherein each distinctive directivity radiation pattern is in an upward direction within the radome.

8. The heat sensing system according to claim 2, wherein the at least one auxiliary antenna is a Yagi-Uda antenna structure.

9. The heat sensing system according to claim 1, wherein the at least one auxiliary antenna is configured in an asymmetric spiral shape.

10. The heat sensing system according to claim 1, wherein the at least one auxiliary antenna is configured in a microstrip dipole shape.

11. The heat sensing system according to claim 1, wherein the at least one auxiliary antenna is configured in a square spiral shape.

12. The heat sensing system according to claim 1, wherein the radome is formed of a dielectric material and the at least one auxiliary antenna is embedded in the dielectric material.

13. A method for dynamic heat sensing in a flight vehicle having a radome surrounding a main antenna configured for sending and/or receipt of a signal and at least one auxiliary antenna associated with a region of the radome, the method comprising:

using the at least one auxiliary antenna to receive infrared or optical energy to determine a measured temperature of the region based on the infrared or optical energy;

using a processor in communication with the auxiliary antenna to determine whether the current temperature exceeds a predetermined temperature;

sending information regarding the measured temperature from the processor to a controller that is in communication with the at least one auxiliary antenna and the processor; and rotating the flight vehicle when the current temperature exceeds the predetermined temperature using the controller.

14. The method of claim 13, wherein using the at least one auxiliary antenna includes using a plurality of infrared or optical antenna structures corresponding to a plurality of regions within the flight vehicle, each of the plurality of infrared or optical antenna structures positioned within one of the plurality of regions to detect the current temperature of the respective region.

15. The method of claim 14, further including:

registering local coordinates of each of the plurality of regions;

identifying a coordinate location of each of the plurality of infrared or optical antenna structures;

correlating each of the plurality of infrared or optical antenna structures with a corresponding one of the plurality of regions;

measuring infrared or optical energy of each of the plurality of infrared or optical antenna structures;

identifying a first region of the plurality of regions that has a highest temperature of the plurality of regions;

identifying a second region of the plurality of regions that has a lowest temperature of the plurality of regions; and determining a temperature difference between the first region and the second region.

16. The method of claim 15, further including re-measuring the infrared or optical energy of each of the plurality of infrared or optical antenna structures when the temperature difference does not exceed a predetermined value.

17. The method of claim 16, further including determining a coordinate difference between the first region and the second region when the temperature difference exceeds a predetermined value.

18. The method of claim 17, wherein rotating the flight vehicle includes rotating the flight vehicle by the coordinate difference between the first region and the second region.

19. The method of claim 18, further including continuously monitoring the current temperature of the plurality of regions of the flight vehicle after the flight vehicle has been rotated.

* * * * *